US006932076B2

(12) United States Patent
Liao et al.

(10) Patent No.: US 6,932,076 B2
(45) Date of Patent: Aug. 23, 2005

(54) DIAMOND CIRCULAR SAW BLADE

(76) Inventors: Chien-Cheng Liao, 36, Lane 145, Dun Ha North Road, Taipei City (TW); Fang-Chun Yu, 18, Alley 123, Lane 668, Ying Tao Road, Ying Ko Town, Taipei County (TW)

( * ) Notice: Subject to any disclaimer, the term of this patent is extended or adjusted under 35 U.S.C. 154(b) by 137 days.

(21) Appl. No.: 10/686,606

(22) Filed: Oct. 17, 2003

(65) Prior Publication Data

US 2005/0081697 A1 Apr. 21, 2005

(51) Int. Cl.[7] ..... B28D 1/04
(52) U.S. Cl. ..... 125/15; 125/18; 125/22
(58) Field of Search ..... 125/15, 13.01, 125/18, 22; 451/547; 83/855

(56) References Cited

U.S. PATENT DOCUMENTS 47,255 A * 4/1865 Drake ..... 125/15
519,475 A * 5/1894 Marquart ..... 125/22
2,073,678 A * 3/1937 Broughton ..... 125/15
2,508,042 A * 5/1950 Rehnberg ..... 51/309
3,196,584 A * 7/1965 Tatko ..... 451/541
3,371,452 A * 3/1968 Mabey ..... 451/541
4,407,263 A * 10/1983 Murata ..... 125/15

* cited by examiner

*Primary Examiner*—M. Rachuba
(74) *Attorney, Agent, or Firm*—Rosenberg, Klein & Lee

(57) ABSTRACT

An enhanced and improved diamond circular saw blade of an invention is disclosed. The invention includes welding and jointing of the periphery of a circular steel blade having an axle bore and a plurality of arc-shaped copper alloy metal-sheets. Each arc-shaped copper alloy metal-sheet includes a plurality of openings, which provide the space required to accommodate a plurality of diamond particles. The width of an opening is somewhat wider than the diameter of an individual diamond particle. When the diamond particles are placed inside each opening of the copper alloy metal-sheets, a pair of molds is used to compress the top and the bottom of a plurality of metal teeth between adjacent openings simultaneously. By compressing this pair of molds, the metal teeth between adjacent openings are deformed, so as to squeeze along the direction of these openings and to enclose and hold the diamond particles. As a result, the surface is of an indentation-shaped saw plate. Therefore, an un-deformed diamond circular saw blade with high performance in rapid cutting is reached, so that not only is the production cost greatly reduced, but also the structure and manufacturing processes thereof are simplified.

1 Claim, 4 Drawing Sheets

DIAMOND CIRCULAR SAW BLADE

BACKGROUND OF THE INVENTION

[1] Field of the Invention

The invention relates in general to an enhanced and improved diamond circular saw blade, and more particularly to an enhanced and improved diamond circular saw blade, which is of an un-deformed, rapid-cutting, and simplified structure thereof.

[2] Description of the Related Art

Generally, diamond cutting saw blades are comprised of a circular plate or disk made of soft metal, such as bronze or steel, having abrasive materials mounted along the entire periphery of the circle as shown in FIG. 1A. The abrasive materials are usually mounted to the periphery of the metal disk by a mechanical press-mounting method, and they are typically composed of diamond particles, so as to form a continuous-rim diamond circular saw blade 10*a* with an excellent cutting effect. However, the diamond circular saw blade 10*a* is made of soft metal sheet materials, and the strength of the plate is usually insufficient for general-purpose, high-speed cutting. In order to improve this disadvantage, R&D of industrial circles provide a segmented-rim diamond circular saw blade 10, which is manufactured by employing a sintering method as shown in FIG. 1. The segmented-rim of diamond circular saw blade 10 is composed of industrial-grade diamond particles and other metal powder materials together, with which are placed in a specially made mold, by a cold press manner to form a powder lump. In order to reinforce its strength, a high temperature of 850° C. is required to form a arc-shaped diamond-metal bars 101 of reinforced composite diamond material. The arc-shaped diamond-metal bars 101 are then welded to the periphery of a circular steel disk 120 having an axle bore, so as to form the segmented-rim diamond circular saw blade 10. Nevertheless, the circular saw blade 10 manufactured by a sintering method as described above requires high-cost industrial-grade diamond particles and other metal powder. In addition, the process of mixing diamond particles with the other metal powders may cause pathological changes to operators' skins. Furthermore, the peripheral equipment system of manufacturing is very costly, and it consumes a large amount of electrical energy with very minute and complicated processes and causes air pollution. As a result of its high production cost, the unit price of the product is very high, which is several times the unit price of the continuous-rim diamond circular saw blade 10*a* manufactured by a mechanical press-mounting method. Therefore, industries' demand for low-cost products cannot be met. In addition, the cutting performance of the segmented-rim diamond circular saw blade 10 (FIG. 1) manufactured by a sintering method is inferior to that of the continuous-rim diamond circular saw blade 10*a* (FIG. 1A) manufactured by a mechanical press-mounting method.

Accordingly, advantages of the diamond circular saw blade 10*a* manufactured by a mechanical press-mounting method as shown in FIG. 1A are low production cost, high cutting performance and easy to manufacture. However, a disadvantage is its lack of mechanical strength. On the other hand, the diamond circular saw blade 10 manufactured by a sintering method has the reinforced mechanical strength and is un-deformed because of the steel material used. Unfortunately, the cutting performance is inferior and the production cost is too high.

SUMMARY OF THE INVENTION

In view of the short-comings of the existing products mentioned above, it is therefore an object to provide an enhanced and improved diamond circular saw blade. The present invention provides an enhanced and improved diamond circular saw blade, which is of an un-deformed, rapid-cutting, and simplified structure.

Other objects, features, and advantages of the invention will become apparent from the following detailed description of the preferred but non-limiting embodiments. The following description is made with reference to the accompanied drawings.

DETAILED DESCRIPTION OF THE INVENTION

Figure 1A:
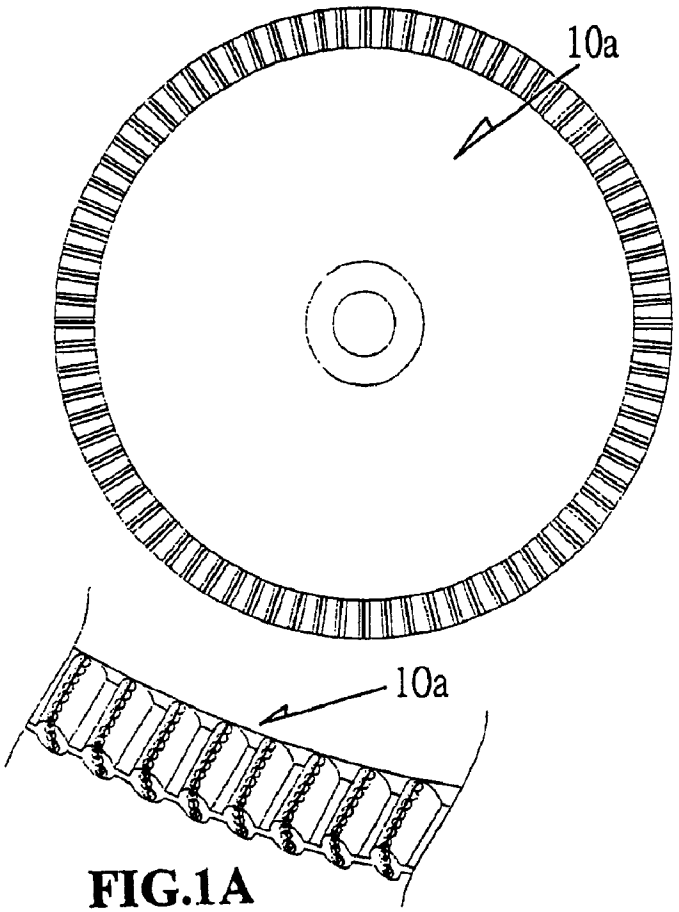
FIG.1A PRIOR ART
FIG. 1A (prior art) is a structural diagram of a diamond circular saw blade, which is manufactured by a mechanical press-mounting method.
Figure 1:
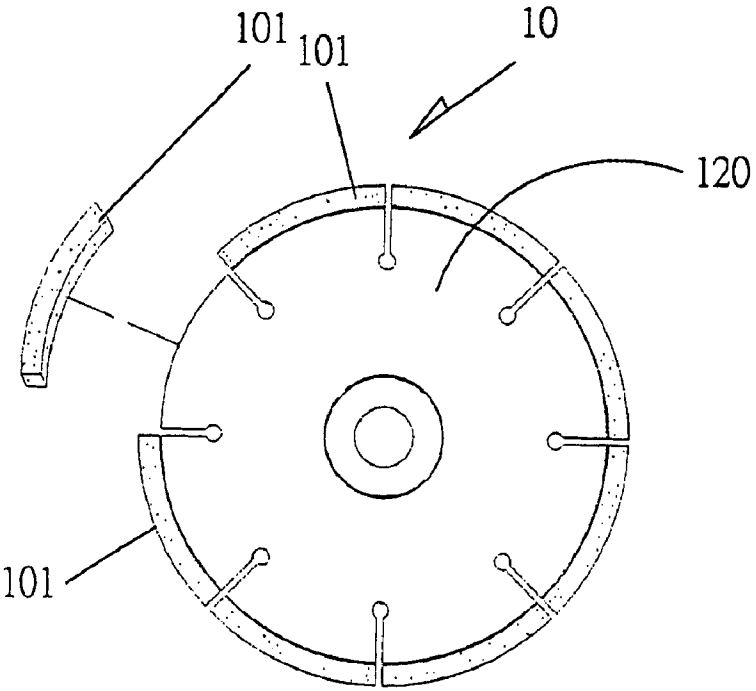
FIG.1 PRIOR ART
FIG. 1 (prior art) is a structural diagram of a diamond circular saw blade, which is manufactured by a sintering method.
Figure 2:
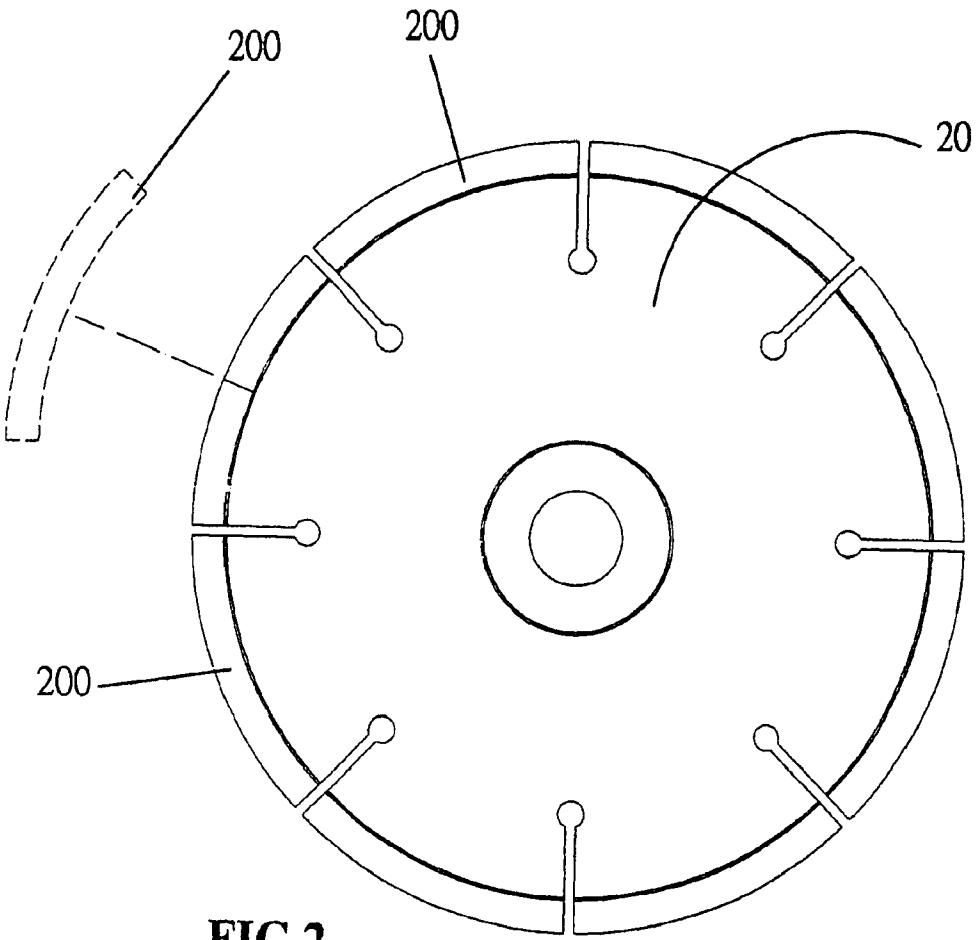
FIG.2 PRIOR ART
FIG. 2 shows a diagram of welding and jointing of a circular steel blade and a plurality of arc-shaped metal-sheets of a present invention.
Figure 3:
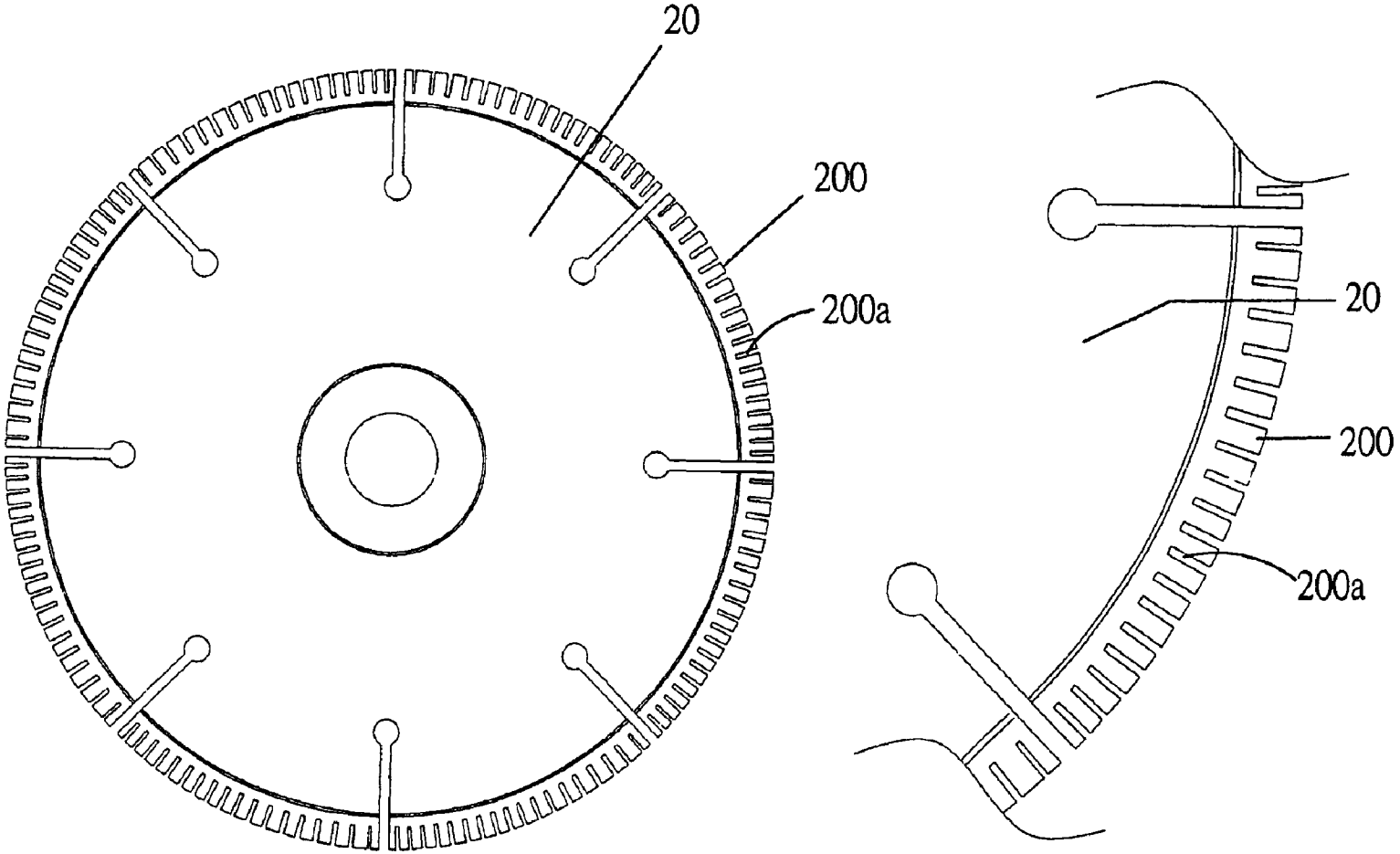
FIG. 3 illustrates a diagram of openings of the arc-shaped metal-sheets of the present invention.
Figure 5:
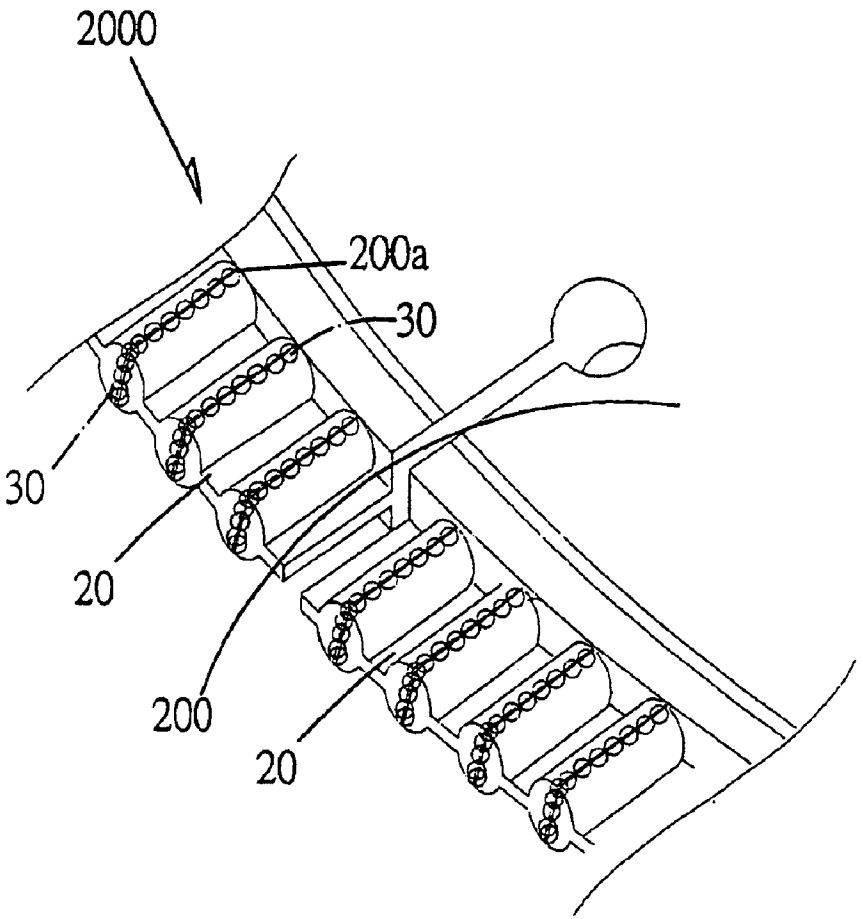
FIG. 5 illustrates a partial three-dimensional diagram of an indentation-shape saw plate, which is formed by compressing and molding the openings of the arc-shaped metal-sheets to mount the diamond particles according to the present invention.
Figure 4:
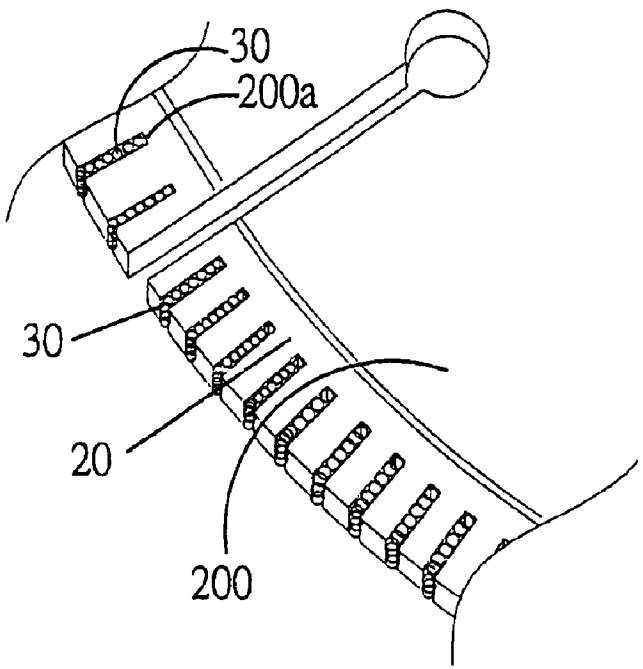
FIG. 4 illustrates a diagram of arranging diamond particles at the openings of the arc-shaped metal-sheets of the present invention.

An enhanced and improved diamond circular saw blade of an invention is disclosed. Referring to FIG. 2, it shows the invention of a preferred embodiment, which includes welding and jointing of the periphery of a circular steel blade 20 having an axle bore and a plurality of arc-shaped copper alloy metal-sheets 200. Referring to FIG. 3, each arc-shaped copper alloy metal-sheet 200 includes a plurality of openings 200*a*, which provide the space required to accommodate a plurality of diamond particles 30 as shown in FIG. 4. The width of an opening 200*a* is somewhat wider than the diameter of a diamond particle 30. When the diamond particles 30 are placed inside each opening 200*a* of the copper alloy metal-sheets 200, a pair of molds is used to compress the top and the bottom of a plurality of metal teeth between adjacent openings 200*a* simultaneously. By compressing with this pair of molds, the metal teeth between two adjacent openings 200*a* are deformed, so as to squeeze along the direction of these openings 200*a* and to enclose and hold the diamond particles 30 in openings 200*a*, as shown in FIG. 5. As a result, the surface is of an indentation-shaped saw plate. Therefore, an un-deformed diamond circular saw blade 2000 with high performance in rapid cutting is reached, so that not only is the production cost significantly reduced, but also the structure and manufacturing processes thereof are simplified.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An enhanced and improved diamond circular saw blade, comprising welding and jointing the periphery of a circular steel blade having an axle bore and a plurality of arc-shaped copper alloy metal-sheets, wherein each arc-shaped copper alloy metal-sheet comprises a plurality of openings, which provide the space required to accommodate a plurality of diamond particles, wherein the width of an opening is somewhat wider than the diameter of an individual diamond particle, wherein when the diamond particles are placed inside each opening of the copper alloy metal-sheets, a pair of molds is used to compress the top and the bottom of a plurality of metal teeth between adjacent openings simultaneously, wherein the metal teeth between adjacent openings are deformed by compressing this pair of molds, so as to squeeze along the direction of these openings and to enclose and hold the diamond particles, wherein the surface is of an indentation-shaped saw plate, so as to have an un-deformed diamond circular saw blade of high performance in rapid cutting.

* * * * *